US006551058B2

(12) United States Patent
Nowack

(10) Patent No.: US 6,551,058 B2
(45) Date of Patent: Apr. 22, 2003

(54) ROTATORY PUMP HAVING A KNOBBED IMPELLER WHEEL, AND A KNOBBED IMPELLER WHEEL THEREFOR

(75) Inventor: Olaf Nowack, Gmuend (DE)

(73) Assignee: Ritz Pumpenfabrik GmbH & Co., KG (DE)

( * ) Notice: Subject to any disclaimer, the term of this patent is extended or adjusted under 35 U.S.C. 154(b) by 0 days.

(21) Appl. No.: 09/803,841

(22) Filed: Mar. 12, 2001

(65) Prior Publication Data

US 2001/0031202 A1 Oct. 18, 2001

(30) Foreign Application Priority Data

Mar. 13, 2000 (DE) ..... 100 12 181

(51) Int. Cl.[7] ..... F04D 29/24

(52) U.S. Cl. ..... 415/140; 415/131; 415/173.1; 415/173.4; 415/174.2; 415/174.4; 415/170.1; 415/206; 416/185; 416/228; 416/236 R; 416/236 A

(58) Field of Search ..... 415/170.1, 173.1, 415/173.4, 174.4, 131, 132, 173.3, 174.2, 140; 416/185, 223 B, 228, 235, 236 R, 236 A

(56) References Cited

U.S. PATENT DOCUMENTS 3,711,218 A 1/1973 Kennel
3,771,927 A * 11/1973 Schiller ..... 415/131
4,375,937 A * 3/1983 Cooper ..... 415/143
4,421,456 A * 12/1983 Huffman ..... 415/170.1
5,800,120 A 9/1998 Ramsay
5,951,244 A 9/1999 Knight, Sr.

FOREIGN PATENT DOCUMENTS

CA 503332 A * 5/1954 ..... 416/223 B
FR 893205 A * 6/1944 ..... 416/236 R

* cited by examiner

*Primary Examiner*—Christopher Verdier
(74) *Attorney, Agent, or Firm*—Hahn Loeser + Parks LLP; Stephen L. Grant

(57) ABSTRACT

A rotatory pump has a housing (20) and an impeller wheel (40) which is mounted on a driving shaft (30) to rotate integrally therewith. The driving shaft is rotatably supported in the housing. The driving shaft also has a disk (44) disposed to be concentric with the driving shaft. Radially extending blades (46) are directed along the axial direction of the driving shaft (30) being provided on the disk, and the blades, together with the inner wall portions (22*a*) of the housing (20) which face the blades (46), form flow channels for the fluid to be pumped. At least one raised portion (48) is on each of the radially extending edges (46*a*) of preferably three blades (46), to bear against the inner wall portions (22*a*) of the housing (20) which face the blades (46) of the impeller wheel housing.

37 Claims, 5 Drawing Sheets

ROTATORY PUMP HAVING A KNOBBED IMPELLER WHEEL, AND A KNOBBED IMPELLER WHEEL THEREFOR

The present invention relates to a rotatory pump, as well as to an impeller wheel for a rotatory pump.

Using rotatory pumps, media or fluids of the most various kinds can be conveyed. These may be gases, flowable solids and liquids, as well as liquids containing solid components and/or fibers.

The pump efficiency of rotatory pumps is determined substantially by the impeller wheel. Good efficiencies may be obtained with impeller wheels having a front cover disk facing the incoming fluid to be conveyed, as well as a rear cover disk facing away from the incoming fluid to be conveyed, with blades or ribs disposed between them. Impeller wheels of this kind are fabricated integrally as finished castings. Because the ribs or blades extend radially outwards along an arc from their footings on the hub of the impeller wheel, impeller wheels of this kind may be cast only by using cores, this rendering the fabrication outlay and therewith the cost of such an impeller wheel correspondingly high.

Furthermore, with housings in the form of castings, the inner wall portions facing the impeller wheels must be machined in order, on the one hand, to create a space for the rotary movement of the impeller wheel, and on the other hand, to establish a seating for the annular gap. This also is labour-consuming and therefore costly.

When closed impeller wheels of this kind are used for conveying fluids containing solid materials or solid bodies, there is a danger of the flow passages formed by the blades and the front and rear cover disk becoming damaged or even blocked.

For this reason, impeller wheels without a front cover disk also are to be found in practice, these being termed non-chokable wheels. With impeller wheels of this kind, the flow channel needed for guiding the fluid to be conveyed is formed by the rear cover disk, the blades disposed thereon, and the housing inner wall portions facing the blades. Because there is no front cover disk, impeller wheels of this kind may be fabricated relatively easily and therefore inexpensively. However, rotatory pumps containing impeller wheels of this kind exhibit a markedly worse efficiency than rotatory pumps having closed impeller wheels.

It is the object of the present invention to produce a rotatory pump which has an impeller wheel that can be simply fabricated and which is of high efficiency. Furthermore, it is the object of the present invention to fabricate a suitable impeller wheel therefor.

The above object is achieved by the features claimed in the appended claims as far as the rotatory pump is concerned. Advantageous developments of this rotatory pump are also claimed.

Owing to the provision of the raised portions or knobs or bulges, the possibility is given of an impeller wheel formed without a front cover disk being disposed so closely to the inner wall portions of the housing that a structure is created which is similar to a closed impeller wheel. However, because there is no front cover disk, the impeller wheel for the rotatory pump of the invention may be fabricated far more easily and therefore at more favorable cost. By means of suitable trials it was possible to show that the rotatory pump of the invention is of an efficiency which is equal to or even higher than that of a rotatory pump having a closed impeller wheel at the same driving power and with the same fluid to be conveyed. For this, an unusual approach, that of the impeller wheel contacting the inner wall portions of the housing, has been adopted. In this, by means of the raised portions an at least point-shaped or line-shaped contact is established between the impeller wheel of the rotatory pump and the inner wall portions of the housing. Following a relatively short running-in period, contact lines or contact faces which are hydraulically smooth form on the raised portions and on the runner groove worked into the inner wall portions of the housing. The fluid to be conveyed then forms a lubricating film between the contact regions, so that the frictional resistance as well as the noise generation of the rotatory pump of the invention does not exceed that of a rotatory pump with a closed impeller wheel.

In principle, the raised portions may be fitted to the blades of the disk or the rear cover disk after the fabrication of the impeller wheel. However, a particularly simple and therefore cost-advantageous manufacture of the raised portions may be achieved by the raised portions being integrally formed onto the blades, so that they may be cast together with the impeller wheel in the casting operation.

In principle, the raised portions may be of any desired shape. However, in order to facilitate the formation of the groove in the inner wall portions of the housing, it is of advantage for the cross-sections of the raised portions, as seen in a longitudinal section, i.e. parallel to the shaft axis, to be of the shape a segment of a circle.

The raised portions may be disposed on the blades at any desired value of the radius. It has been shown to be of particular advantage for each of the raised portions to be disposed approximately in a region at the mid-radius position of a blade.

In order to ensure a reliable contact of the raised portions with the inner wall portions of the housing even after the running-in phase, it is of advantage for the fitting clearance of the disk on the driving shaft to be smaller than the height of the raised portions, as measured along the axial direction of the driving shafts.

In principle, in the case of a plurality of raised portions, these may be disposed at different radial distances along the respective blade. However, in order to keep the frictional resistance low, in particular during the running-in period, it is of advantage for the raised portions to be disposed on the blades to lie in a circle concentric with the axis of the driving shaft at equal spacings, in particular of 120°.

Furthermore, if the housing is fabricated as a casting, it has been shown to be of advantage for at least the inner wall portions of the housing facing the blades to be not machined. This ensures, by making use of the hard cast skin, that the raised portions do not penetrate too deeply and that bearing faces of sufficient hardness are formed, so that uniform running of the impeller wheel is ensured.

Furthermore, in order to ensure that the raised portions bear in a defined manner against the inner wall portions of the housing which face the blades, a biasing or adjusting device may be provided, by means of which the raised portions may be urged against the inner wall portions of the housing which face the blades.

In this case, in order to ensure a compact construction and a simple assembly, the biasing or adjusting device may be disposed on the driving shaft on that side of the disk which faces away from the blades. If the biasing or adjusting device is disposed on that side of the cover disk which faces the blades, then there will result with the same structural components, in particular with the same impeller wheel, a second rotatory pump which, although the raised portions no longer bear against or contact the inner wall portions of the housing which face the blades to thus form narrow flow channels, may be used, for example for liquids with very large solid matter components, or even for solid materials, for example for conveying air- and gas-containing media as well as those which easily tend to cause choking. In the same way, a gentle conveying of solid matter particles, even of slightly abrasive components in the medium being conveyed, may be achieved with this rotatory pump. Thus, using the solution proposed by the invention, a "building block system" of different rotatory pumps may be established.

If the biasing or adjusting device is designed to be of spring-like elasticity, then it will be possible for the impeller wheel to reversibly give way along the axial direction when a penetration by solid matter occurs, so that damage to the blades and/or the inner wall portions of the housing which face the blades is prevented.

For this, the biasing or adjusting device may be constituted by mechanical components of the most various kinds. For example, the biasing or adjusting device may be formed by a metallic spring member, in particular a helical pressure spring, and particularly also a conical pressure spring or an annular member made of an elastomer, in particular rubber.

As far as the impeller wheel is concerned, the above object is achieved by the features claimed in the appended claims, including advantageous developments. The same advantages apply to the impeller wheel of the invention as have been set out initially in connection with the rotatory pump of the invention.

Further advantageous developments as well as examples of embodiment are set out hereunder with reference to the accompanying drawings. The terms "upper", "lower", "right-hand" and "left-hand", as used in connection with the description of the examples of embodiment, relate to the Figures of the drawings when oriented in a viewing position in which the reference symbols are readable in normal manner. In these:

Figure 1:
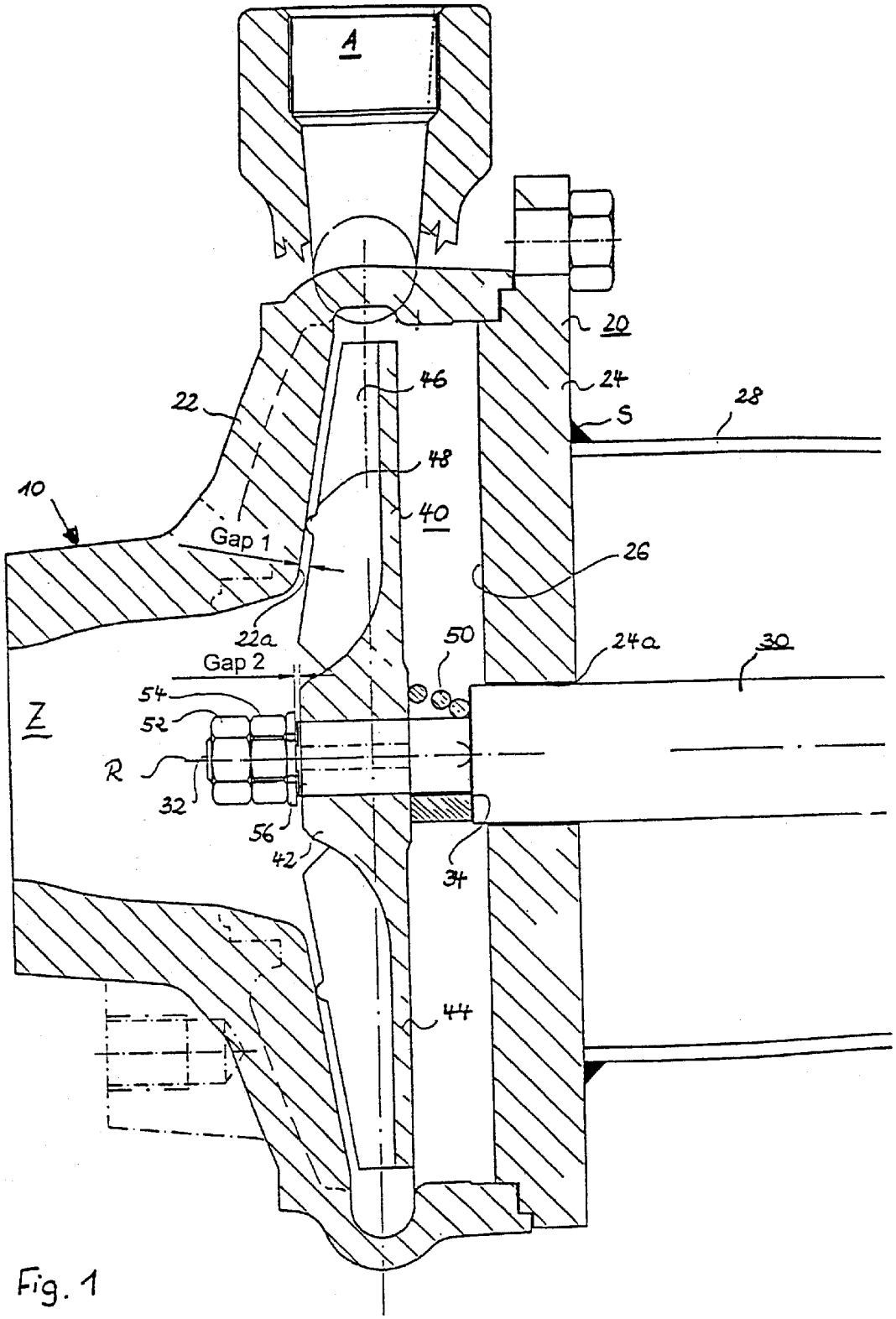
FIG. 1 is a cross-section through a first example of embodiment of a rotatory pump of the invention.
Figure 4:
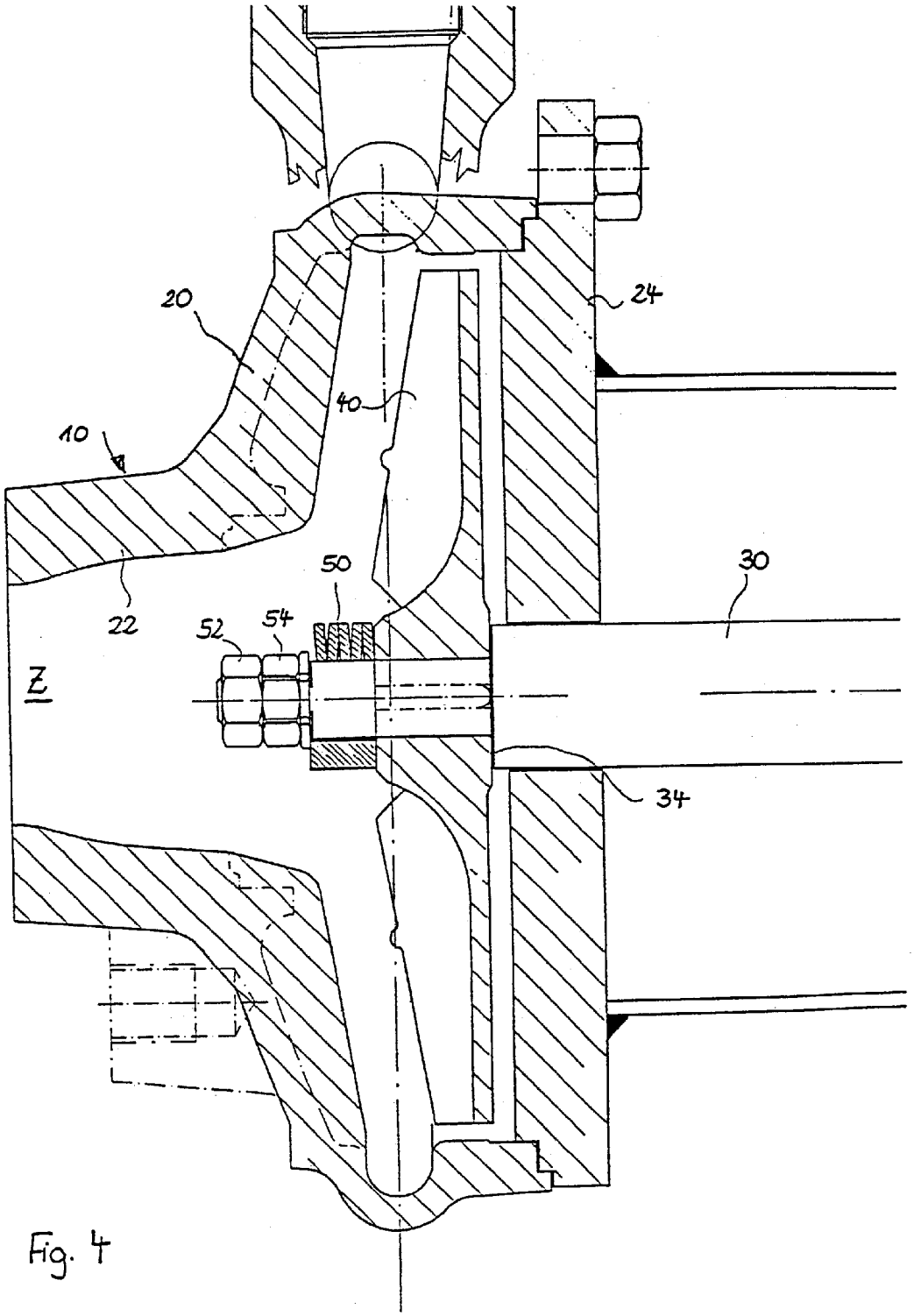
FIG. 4 is a cross-sectional view of a second example of embodiment of a rotatory pump of the invention.

The rotatory pump 10 of the invention shown in FIG. 1 has as its main structural groups a housing 20, a driving shaft 30, and also an impeller wheel 40. In FIGS. 1 and 4 the inlet of the rotatory pump is designated by "Z" and the outlet by "A".

As is evident from FIG. 1, the housing 20 has a first housing part 22 and a second housing part or housing cover 24 which are connected to each other across a radial dividing plane by suitable connecting means, such as bolts for example, and thereby form a hollow space 26 inside which the impeller wheel 40 is rotatably disposed. The first housing part 22, in particular, is formed as a casting and has, as seen in a longitudinal cross-section, the shape of a bowl with a pedestal. The inlet Z is formed in the pedestal portion, whereas the outlet is provided on the radial edge of the bowl portion. The second housing part 24 may be a simple steel plate of circular shape. Of course, the second housing part 24 may also be formed as a casting.

A connecting tube 28 is disposed on the right-hand outer side of the second housing part 24 and extends substantially horizontally and is mounted to the outer side of the second housing part 24 by means of a welding seam S. The electric motor, not illustrated, for driving the rotatory pump 10 of the invention may be disposed inside the connecting tube 28. Furthermore, the substantially horizontally extending driving shaft 30 which is connected to the motor to rotate integrally therewith is disposed inside the connecting tube 28. Of course, the rotatory pump of the invention may also be so installed that the driving shaft 30 extends vertically; this being the installation position most frequently encountered. The illustrated shaft end 32 of the driving shaft 30 passes through a through bore 24*a* of the second housing part 24. Furthermore, the shaft 30 is provided with a shaft shoulder 34, the purpose of which will be explained below.

The already mentioned impeller wheel 40 is mounted, for example by means of a feather key, on the illustrated shaft end 32 of the shaft 30 to rotate integrally therewith. The impeller wheel 40 is held in an axial position on the shaft 30, on the one hand by a biasing or adjusting device 50 described in detail hereunder and supported on the shaft shoulder 34, and on the other hand by two securing nuts 52, 54 screwed onto the shaft end 32 which is on the left-hand side of the impeller wheel 40 and is provided with a suitable thread. A securing ring 56 is provided between the impeller wheel 40 and the side of the securing nut 54 facing the impeller wheel 40. Furthermore, a fitting clearance, designated in FIG. 1 by "Gap 2", is provided between the securing ring 56 and that end face of the impeller wheel 40 which faces the nuts 52, 54.

Figure 3:
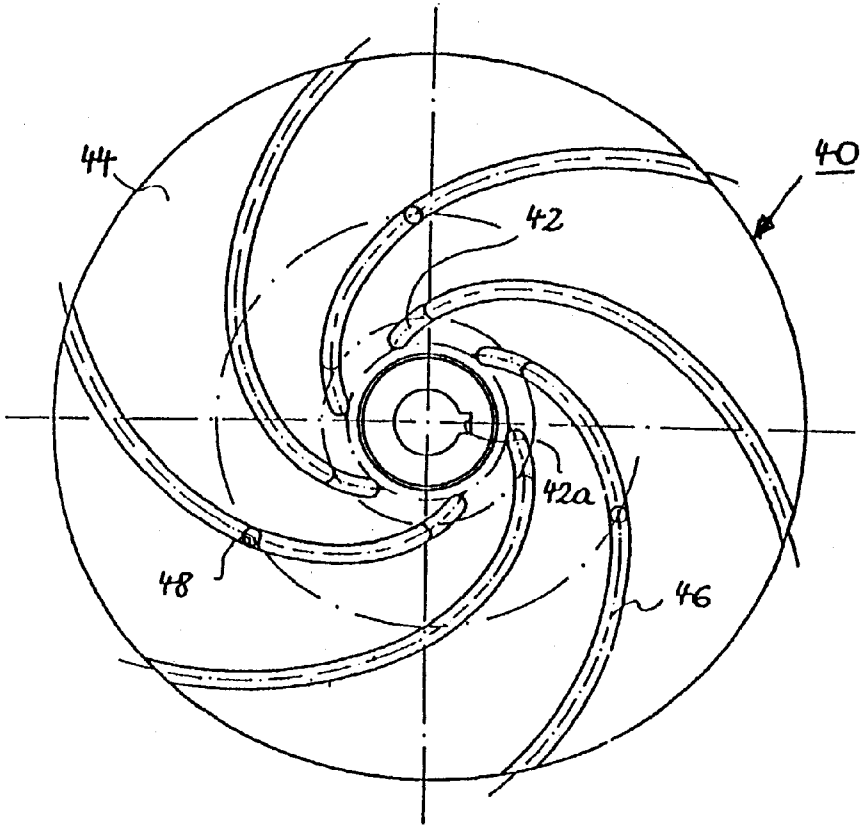
FIG. 3 is a plan view of the impeller wheel shown in FIG. 2 along the direction X of FIG. 2.
Figure 2:
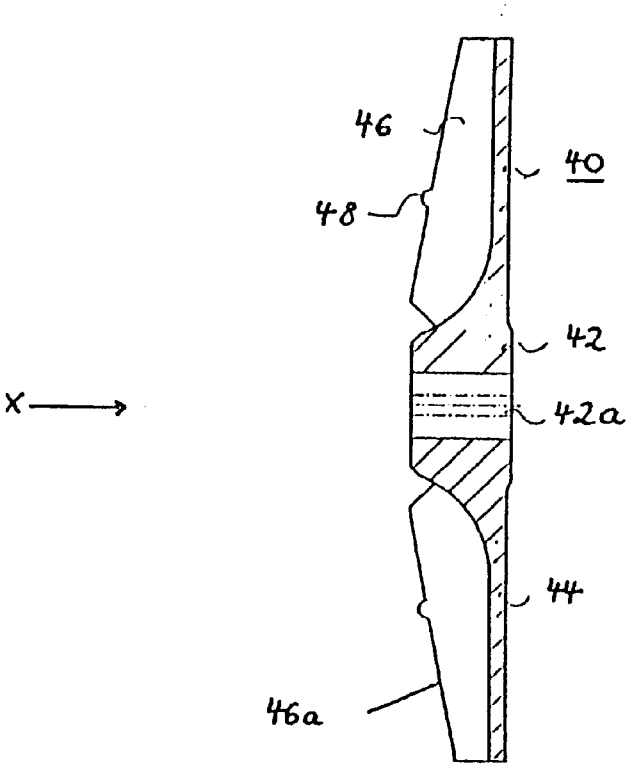
FIG. 2 is a reduced cross-sectional view of an impeller wheel of the invention as used in the rotatory pump of FIG. 1.

As is evident from FIG. 2, the impeller wheel 40 possesses a hub 42, on the inner circumference of which a keyway 42*a* is formed (see also FIG. 3) for receiving the rotational drive from the driving shaft 30. A circular disk 44 which is integrally disposed on the hub 42 to be concentric with the shaft axis R extends radially outwards form the right-hand end face of the hub 42. Blades 46 are integrally formed on the disk 44 which is also formed as a casting, to extend radially outwards in the shape of an arc from the hub 42 as far as the outer circumference of the impeller wheel 40 or the disk 44, as is evident from FIG. 3. A total of six blades or vanes 46 are provided at uniform spacings of 60°.

On three of the six blades 46 which are disposed with respect to each other at a spacing of about 120°, i.e. on the second, fourth and sixth blade 46, three raised portions or knobs 48 are formed to lie on a common imaginary circle. The raised portions 48 possess, with reference to the axis R of the driving shaft 30, a circular segment shaped cross-section and are disposed approximately at the mid-radius position of each blade 46.

As is evident from FIG. 1, the raised portions 48 contact those inner wall portions 22*a* of the second housing part 22 which together with the blades 46 form radially extending flow channels for the medium or fluid to be conveyed. Herein the height of the raised portions 48, as measured along the axial direction of the driving shaft 30, determines the gap formed between the blades 46 and the inner wall portions 22*a* of the first housing part 22, which is designated as "Gap 1" in FIG. 1. This gap 1 becomes a little smaller during a running-in period of the rotatory pump 10 of the invention, because the raised portions 48 slightly work their way into the inner wall portions 22*a* and form a groove corresponding to their shape, which is not shown in FIGS. 1 and 4. However, the unmachined and therefore hard inner wall portions 22*a* of the first housing part 22, resulting from the casting skin which is still present, ensure that during the normal operation of the rotatory pump 10 and its average lifetime the gap 1 will always be greater than the fitting clearance of the gap 2.

Because of the hardness of the inner wall portions 22*a*, hydraulically smooth faces form on the groove and also on the contact faces of the raised portions 48. The fluid to be conveyed then provides a lubrication between the contact faces of the groove and the raised portions, so that the rotatory pump 10 of the invention operates with little resistance and also low noise.

In order to ensure that the raised portions 48 reliably bear against the inner wall portions 22*a* of the first housing part 22 and, in particular, to achieve reliable contacting after the running-in period during which the raised portions 48 work a groove into the facing inner wall portions 22*a* of the first housing part 22, as has been set out above, the biasing or adjusting device 50 already mentioned above is provided. This biasing or adjusting device 50 is supported, on the one hand, by the shaft shoulder 34 and, on the other hand, by the right-hand end face of the hub 42 of the impeller wheel 40. Because of the elastic design of the biasing or adjusting device 50, the impeller wheel 40 and the raised portions 48 are urged against the inner wall portions 22*a* of the first housing part 22 by a defined force. Furthermore, the biasing device 50 enables the impeller wheel 40 to escape along the axis in the direction of the shaft shoulder 34 during an ingress of foreign bodies of a size exceeding the size of the flow channel formed by the disk 44 with the blades 46 and the inner wall portions 22*a* of the first housing part 22. Following the passing of this foreign body, the impeller wheel 40 will be urged back into its initial position by the biasing device 50.

In FIG. 4 a further embodiment of the rotatory pump of the present invention is shown, which differs from the embodiment shown in FIG. 1 substantially in that the biasing device 50 is disposed between the securing nuts 52, 54 and the left-hand end face of the hub 42 of the impeller wheel 40. The impeller wheel 40 thus bears against the shaft shoulder 34. This condition may be designated as representing a rotatory pump with a "switched-off" biasing device 50, whereas in the rotatory pump shown in FIG. 10 the biasing device 50 is represented as being "switched-on".

Figure 5:
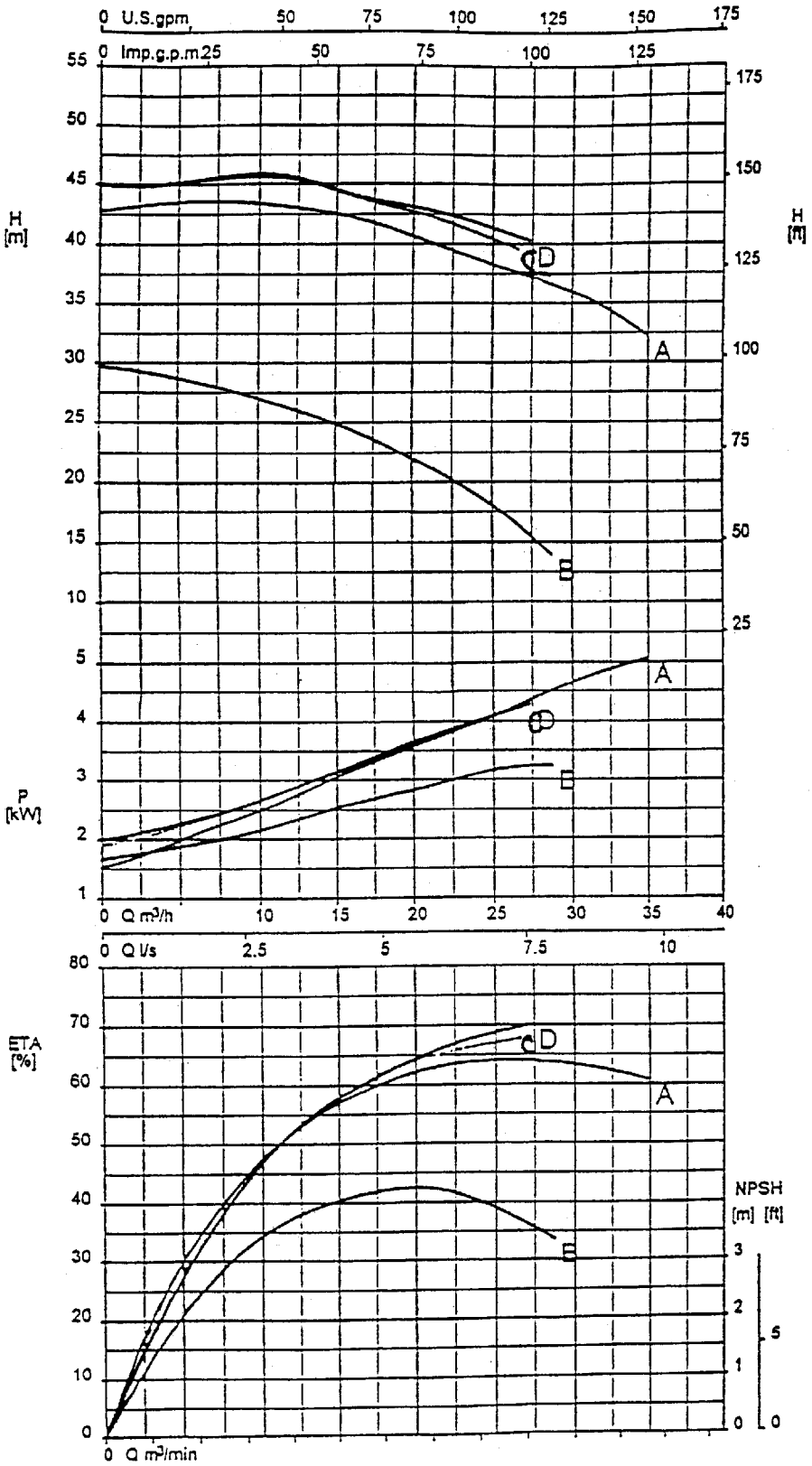
FIGS. 5,6 are diagrams of characteristics of various rotatory pumps.
Figure 6:
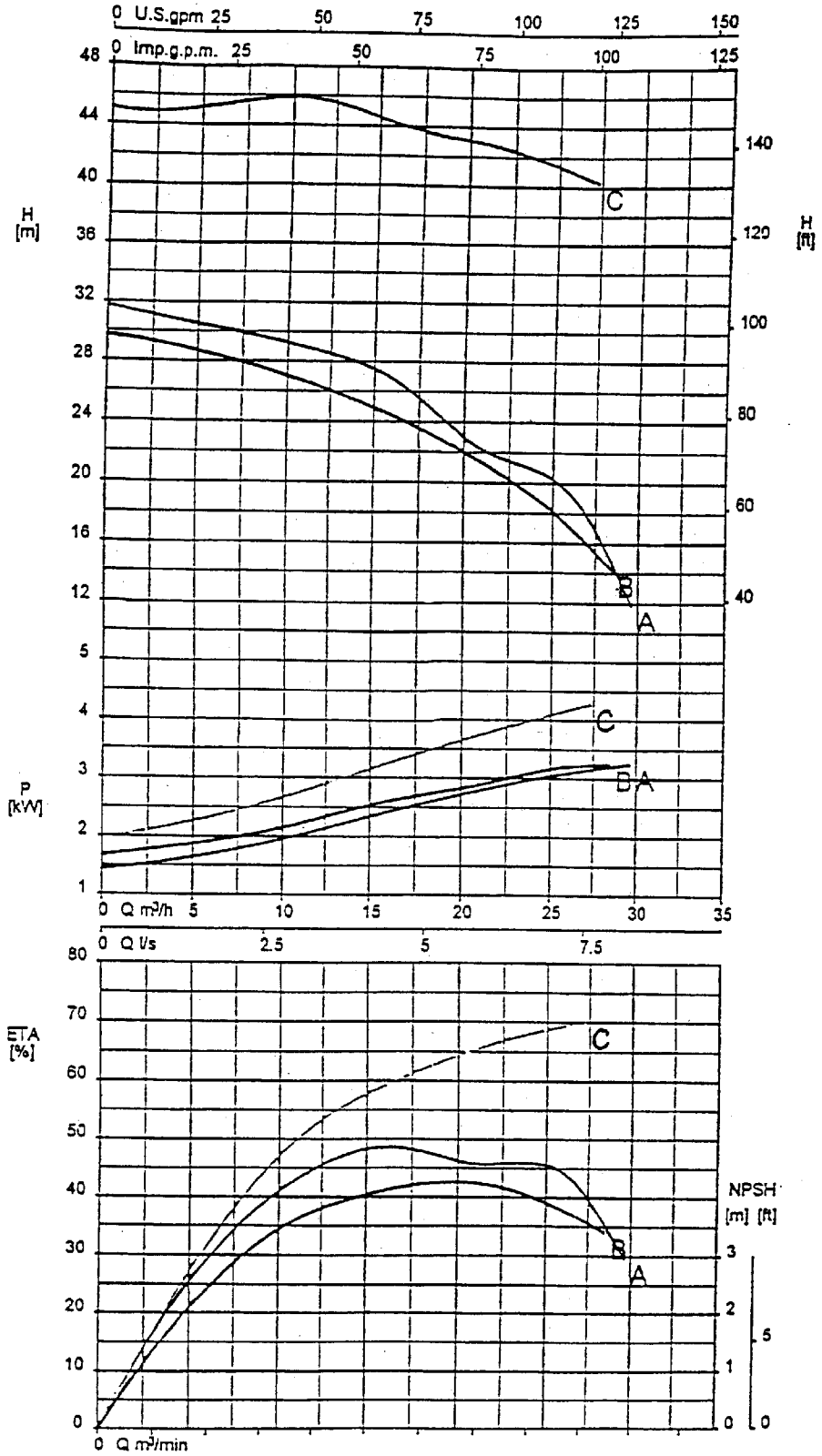

In FIGS. 5 and 6 diagrams showing the characteristic curves of various rotatory pumps can be found. In both Figures the diagram includes the lift H in m, as well as the power consumption in kW plotted against the flow rate Q in $m^3/h$ for various rotatory pumps, whereas the lower diagram shows the efficiency ETA in % plotted against the flow rate Q in $m^3/min$. In FIG. 5 the letter "A" in the upper and lower diagram relates to a known rotatory pump with a closed impeller wheel. The letter "EB" designates a known rotatory pump with a known non-chokeable wheel. As can be seen directly from FIG. 5, the efficiency of the rotatory pump with a closed impeller wheel is greater than the efficiency of the rotatory pump with a non-chokeable wheel. The letters "C" and "D" designate a rotatory pump 10 with an impeller wheel 40 according to the invention, as is shown in FIGS. 1 to 4. As can also be seen directly, the rotatory pump 10 of the invention has approximately the same efficiency, but at larger flow rates a greater efficiency than a rotatory pump with a closed impeller wheel (line A) or a rotatory pump with a known non-chokeable impeller wheel (line B). The difference between the characteristic curves marked with the letters "C" and "D" is that the curve marked with the letter "D" shows the shape attained after about 7 weeks of long-time testing with the rotatory pump 10 of the invention.

In FIG. 6 a known rotatory pump is designated by the letter "A". The letters "B" and "C" designate a rotatory pump 10 of the invention, the letter "B" designating the rotatory pump 10 of the invention according to FIG. 4, and the letter "C" designating the rotatory pump of the invention according to FIG. 1. As can be seen directly from FIG. 6, the efficiency of the rotatory pump 10 of the invention according to FIG. 1 is markedly higher than the efficiency of the known rotatory pump having a known non-chokeable wheel, and that of the rotatory pump 10 of the invention according to FIG. 4. However, it can also be seen that the rotatory pump 10 of the invention according to FIG. 4 nevertheless provides a satisfactory efficiency.

What is claimed is:

1. A rotatory pump for pumping a fluid, said pump having a housing having inner wall portions and an impeller wheel which is mounted on a driving shaft to rotate integrally therewith, said driving shaft being rotatably supported in said housing, and which has a disk disposed to be concentric with said driving shaft, radially extending blades directed along the axial direction of said driving shaft being provided on said disk, and said blades, together with the inner wall portions of the housing which face the blades, forming flow channels for the fluid to be pumped, characterized in that at least one raised portion is provided on each of the radially extended edges of the blades, and that said raised portions bear against the inner wall portions of the housing which face the blades of the impeller wheel.

2. The pump according to claim 1, characterized in that the raised portions are formed integrally on the blades.

3. The pump of claim 1, wherein in a longitudinal section parallel to the axis of the driving shaft, the raised portions have a circular-segment shaped cross-section.

4. The pump of claim 1, wherein the raised portions are each disposed approximately in a region at the mid-radius position of a blade.

5. The pump of claim 1, wherein a fitting clearance of the impeller wheel on the driving shaft is smaller than the height of the raised portions as measured along the axial direction of the driving shaft.

6. The pump of claim 1, wherein the raised portions are disposed on the blades to lie on a circle concentric with the axis of the driving shaft at uniform spacings.

7. The pump of claim 1, wherein the housing is a casting, characterized in that at least the inner wall portions of the housing which face the blades are not machined.

8. The pump of claim 1, wherein an adjusting device is provided, by means of which the raised portions are urged to bear against the inner wall portions of the housing which face the blades.

9. The pump according to claim 8, characterized in that the adjusting device is disposed on the driving shaft on that side of the disk which faces away from the blades.

10. The pump according to claim 8, characterized in that the adjusting device is disposed on the driving shaft on that side of the disk which faces the blades.

11. The pump of claim 8, wherein the adjusting device is designed to be of spring-like elasticity.

12. The pump according to claim 11, characterized in that the adjusting device is formed by a metallic spring member, in a particular helical compressing spring.

13. The pump according to claim 11, characterized in that the adjusting device is formed by an annular member made of an elastomer.

14. An impeller wheel for a rotatory pump for pumping a medium, said pump having a driving shaft and a housing for accommodating the impeller wheel, the housing having inner wall portions, the impeller wheel having a disk adapted to be disposed on the driving shaft to be integrally rotatable therewith and concentric to an axis thereof, blades being disposed on one side of said disk to form parts of flow channels for the medium to be pumped, characterized in that at least one raised portion is disposed on each of the radially extending edges of the blades which bears against the inner wall portions.

15. The impeller wheel according to claim 14, characterized in that the raised portions are formed integrally with the blades.

16. The impeller wheel according to claim 14, characterized in that in a longitudinal section parallel to the axis of rotation of the disk, the raised portions have a circular-segment shaped cross-section.

17. The impeller wheel of claim 14, wherein the raised portions are each disposed approximately in a region at the mid-radius position of a blade.

18. The impeller wheel of claim 14, wherein the raised portions are disposed on the blades to lie on a circle concentric with the axis of rotation of the disk at uniform spacings.

19. The impeller wheel of claim 14, wherein the impeller wheel is a non-chokeable wheel.

20. In a centrifugal pump for pumping a fluid, the pump comprising a housing having at least one inner wall portion, with a drive shaft rotatably supported therein, and an impeller integrally mounted on the drive shaft to rotate in the housing, the impeller comprising a central hub and a disk disposed to be concentric with the drive shaft, a plurality of radially extending blades provided on the disk, each of the plurality of blades directed axially outwardly from the disk and radially outwardly from the hub relative to the drive shaft, each of the plurality of blades terminating in a radially extending edge, wherein at least some of the edges have at least one raised portion provided thereon, so that each of the raised portions bear against one of said at least one inner wall portions that face the blades to form flow channels for the fluid.

21. The pump of claim 20, wherein each of the at least one raised portions is integrally formed on the blade on which it is provided.

22. The pump of claim 20, wherein each of the at least one raised portions has a circular-segment-shaped cross-section in a longitudinal section parallel to an axis of the drive shaft.

23. The pump of claim 20, wherein each of the at least one raised portions is disposed at a mid-radius position on the blade on which it is provided.

24. The pump of claim 20, wherein a fitting clearance of the impeller on the drive shaft is smaller than the height of each of the at least one raised portions as measured along the axial direction of the drive shaft.

25. The pump of claim 20, wherein each of the at least one raised portions is disposed on the blade on which it is provided to lie on a circle concentric with the axis of the drive shaft.

26. The pump of claim 25, wherein the at least one raised portions are uniformly angularly spaced on the circle.

27. The pump of claim 20, wherein the housing is formed by casting and the inner wall portions thereof that face the blades are not machined.

28. The pump of claim 20, wherein each of the raised portions are made to bear against the inner wall portions that face the blades by a biaser.

29. The pump of claim 28, wherein the biaser is disposed on the drive shaft on a side of the impeller opposite the blades.

30. The pump of claim 28, wherein the biaser is disposed on the drive shaft on a side of the impeller on which the blades are disposed.

31. The pump of claim 28, wherein the biaser is a metallic member.

32. The pump of claim 31, wherein the biaser is a helical compressing spring.

33. The pump of claim 28, wherein the biaser is an annular elastomeric member.

34. The pump of claim 1, wherein the driving shaft has three blades.

35. The pump of claim 6, wherein the uniform spacings are 120°.

36. The impeller wheel of claim 14, wherein the driving shaft has three blades.

37. The impeller wheel of claim 18, wherein the uniform spacings are 120°.

* * * * *